US009075366B2

(12) United States Patent
Taki et al.

(10) Patent No.: US 9,075,366 B2
(45) Date of Patent: Jul. 7, 2015

(54) IMAGE FORMING APPARATUS

(75) Inventors: Kenji Taki, Toyokawa (JP); Masaharu Hashizume, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 146 days.

(21) Appl. No.: 13/328,740

(22) Filed: Dec. 16, 2011

(65) Prior Publication Data

US 2012/0155943 A1 Jun. 21, 2012

(30) Foreign Application Priority Data

Dec. 21, 2010 (JP) ..... 2010-284955

(51) Int. Cl.
*G03G 15/00* (2006.01)
*B65H 85/00* (2006.01)
*G03G 15/23* (2006.01)

(52) U.S. Cl.
CPC .... *G03G 15/234* (2013.01); *G03G 2215/00586* (2013.01)

(58) Field of Classification Search
CPC ..... B65H 2301/33312; B65H 85/00; G03G 15/00; G03G 15/234; G03G 2215/00586
USPC ..... 399/309, 364, 401, 402; 347/104
See application file for complete search history.

(56) References Cited

U.S. PATENT DOCUMENTS 6,539,198 B2 3/2003 Miyajima
6,736,390 B2 * 5/2004 Chihara ..... 271/186
7,549,723 B2 * 6/2009 Mihara et al. ..... 347/23
8,220,797 B2 * 7/2012 Yamamoto et al. ..... 271/302
2006/0133844 A1 * 6/2006 Konno ..... 399/82
2006/0228126 A1 * 10/2006 Nihei ..... 399/82
2008/0181696 A1 * 7/2008 Lee et al. ..... 399/364

FOREIGN PATENT DOCUMENTS

JP 10157212 A * 6/1998 ..... B41J 29/46
JP 2001-117291 4/2001
JP 2001326785 A * 11/2001 ..... G03G 15/00
JP 2002-37540 2/2002

(Continued)

OTHER PUBLICATIONS

Machine translation of AAPA reference JP 2001-117291 Takagi Fumio Publised Apr. 27, 2001.*

(Continued)

*Primary Examiner* — Nguyen Ha
(74) *Attorney, Agent, or Firm* — Holtz, Holtz, Goodman & Chick PC

(57) ABSTRACT

An image forming apparatus includes a circulation unit and a controller. The circulation unit includes a plurality of reversing units each configured to reverse a sheet of recording media having one surface printed at an image processor. The circulation unit re-feeds the reversed sheet of recording media to the image processor. During duplex printing of a plurality of sheets of recording media through circulation in the circulation unit, the controller controls a holding reversing unit among the plurality of reversing units to hold at least one sheet among the plurality of sheets, so as to increase an actual circulated sheet number of the circulated plurality of sheets by a number corresponding to the at least one sheet so that the actual circulated sheet number is larger than a predetermined circulated sheet number by the number corresponding to the at least one sheet.

18 Claims, 10 Drawing Sheets

(56) References Cited

FOREIGN PATENT DOCUMENTS

| | | | | | |
|---|---|---|---|---|---|
| JP | 2002-323800 | | 11/2002 | | |
| JP | 2006-69693 | | 3/2006 | | |
| JP | 2007225769 | A * | 9/2007 | ..... | G03G 15/00 |

OTHER PUBLICATIONS

Notification of Reason(s) for Refusal mailed Jan. 30, 2013, directed to Japanese Application No. 2010-284955; 7 pages.

* cited by examiner

FIG. 3

T

| Predetermined circulated sheet number Cs | Predetermined length Ls |
|---|---|
| 5 sheets | ２１０mm(＝Ｌｓ５) |
| 4 sheets | ２９４mm(＝Ｌｓ４) |
| 3 sheets | ３７８mm(＝Ｌｓ３) |
| 2 sheets | ４６２mm(＝Ｌｓ２) |

FIG. 4
Fig. 4A
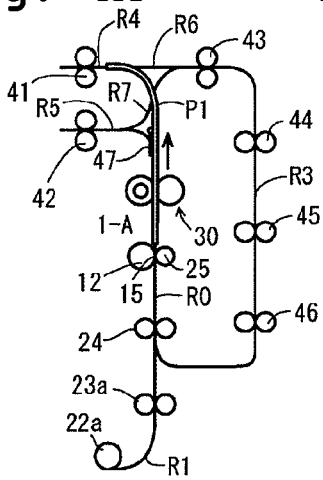
Fig. 4B
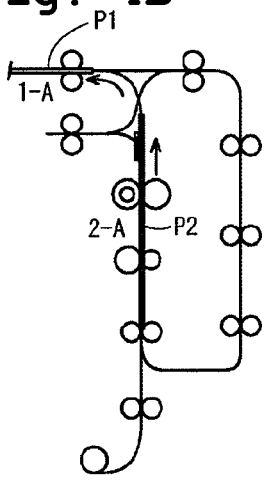
Fig. 4C
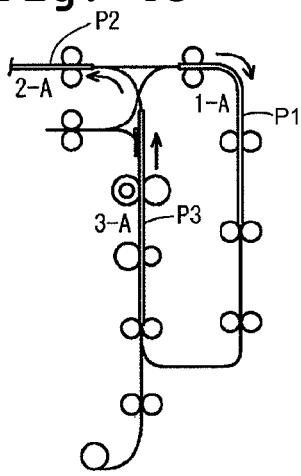
Fig. 4D
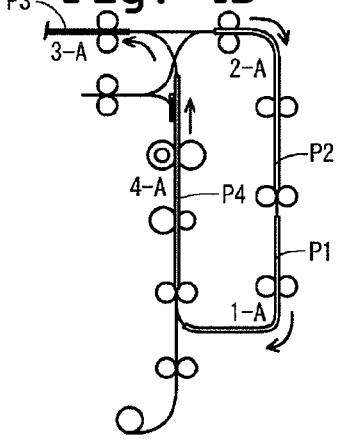
Fig. 4E
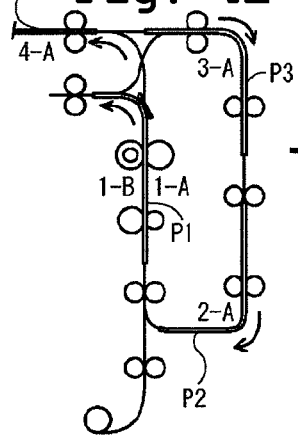
Fig. 4F
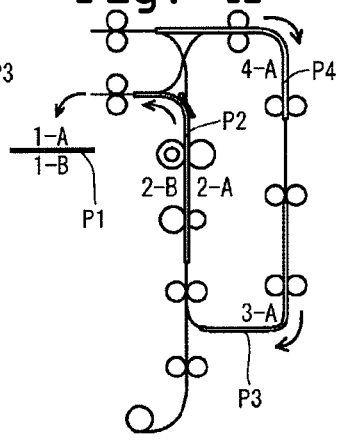
Fig. 4G
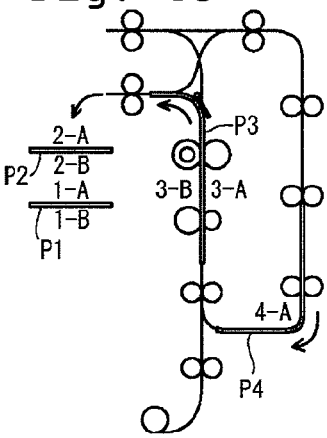
Fig. 4H
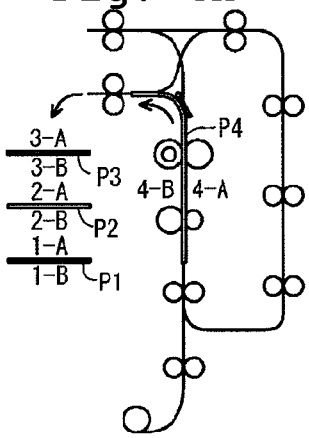
Fig. 4I
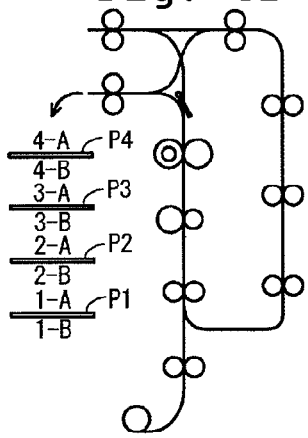

IMAGE FORMING APPARATUS

CROSS-REFERENCE TO RELATED APPLICATIONS

The present application claims priority under 35 U.S.C. §119 to Japanese Patent Application No. 2010-284955, filed Dec. 21, 2010. The contents of this application are incorporated herein by reference in their entirety.

BACKGROUND OF THE INVENTION

1. Field of the Invention

The present invention relates to an image forming apparatus.

2. Discussion of the Background

Duplex printing on electrographic image forming apparatuses involves printing (forming an image onto) one surface of a sheet of recording media at an image processor, reversing the sheet of recording media at a reversing unit, re-feeding the reversed sheet of recording media to the image processor, and printing the other surface of the sheet of recording media. When a plurality of sheets of recording media are duplex printed consecutively, a predetermined number of sheets among the plurality of sheets of recording media are grouped into one unit for one-surface printing and the other-surface printing. For example, assume that the predetermined number is four. In this case, four sheets of recording media are first subjected to one-surface printing consecutively, next circulated and reversed, and then subjected to the other-surface printing consecutively.

As used herein, the predetermined number of sheets refers to the maximum number of sheets of recording media simultaneously containable in the path through which the recording media are circulated (the maximum number being hereinafter referred to as the circulated sheet number). The circulated sheet number is basically determined based on the entire length of the path in relation to the length of a sheet of recording media in the conveyance direction.

For example, Japanese Unexamined Patent Application Publication No. 2002-37540 discloses an image forming apparatus that sets a circulated sheet number based on the size and type of recording media, and consecutively duplex prints a plurality of sheets of the recording media corresponding to the circulated sheet number that has been set.

Generally, the entire length of the path is set to direct highest duplex productivity to the circulation of most frequently used recording media (for example, A4 in portrait). Thus, the path is designed based on the circulation of A4 in portrait. For example, when the circulated sheet number of A4 in portrait is five, the entire length of the path is set to ensure that printing one surface of the fifth sheet of recording media is immediately followed by printing the other surface of the first sheet. The duplex productivity is high when during consecutive duplex printing, the interval of conveyance between the last and first sheets of recording media is not significantly different from the corresponding interval in consecutive simplex printing. That is, high duplex productivity is when consecutive duplex printing shows a similar level of efficiency to the level of efficiency shown by consecutive simplex printing (simplex productivity). When A4 in portrait is conveyed, its shorter sides are orthogonal to the conveyance direction and the longer sides are 210 mm in the conveyance direction.

SUMMARY OF THE INVENTION

According to one aspect of the present invention, an image forming apparatus includes a circulation unit and a controller.

The circulation unit includes a plurality of reversing units each configured to reverse a sheet of recording media having one surface printed at an image processor. The circulation unit is configured to re-feed the reversed sheet of recording media to the image processor. During duplex printing of a plurality of sheets of recording media through circulation in the circulation unit, the controller is configured to control a holding reversing unit among the plurality of reversing units to hold at least one sheet among the plurality of sheets, so as to increase an actual circulated sheet number of the circulated plurality of sheets by a number corresponding to the at least one sheet held at the holding reversing unit so that the actual circulated sheet number is larger than a predetermined circulated sheet number by the number corresponding to the at least one sheet held at the holding reversing unit. The predetermined circulated sheet number is determined in accordance with a length of the recording media in a conveyance direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3 is a circulated sheet number table showing a predetermined length in relation to a circulated sheet number;

FIGS. 4A to 4I are diagrams illustrating an order of printing a plurality of sheets of recording media in normal duplex mode;

DESCRIPTION OF THE EMBODIMENTS

Figure 1:
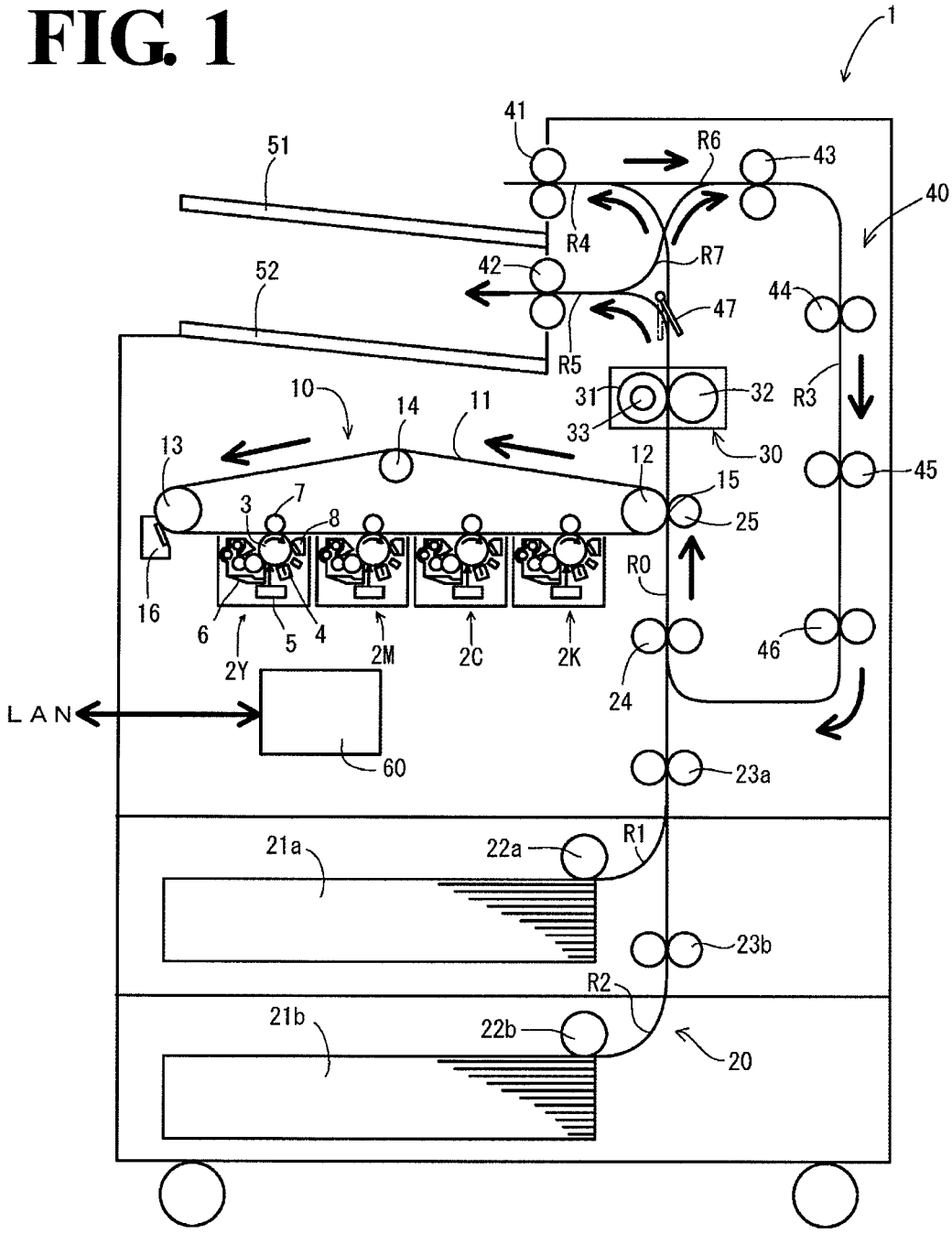
FIG. 1 is a schematic explanatory view of a printer.

The embodiments will now be described with reference to the accompanying drawings, wherein like reference numerals designate corresponding or identical elements throughout the various drawings.

First Embodiment

In the embodiments, a tandem color digital printer (hereinafter referred to as a printer) will be described as an example of the image forming apparatus.

As shown in FIG. 1, a printer 1 has a circulating duplex printing function, and includes an image processor 10, a feeder 20, a fixing unit 30, a circulation unit 40, and a controller 60. The printer 1 is coupled to a network such as a LAN so that upon receipt of a print command from an external terminal, the printer 1 executes printing jobs based on the command, which is not elaborated in the drawings. The printing jobs include a job in simplex mode, in which only one surface of a sheet of recording media P is printed (loaded with an image), and a job in duplex mode, in which both surfaces of the sheet of recording media P is printed.

The image processor 10 transfers toner images on photoreceptor drums 3, which are exemplary image carriers, to the sheet of recording media P. The image processor 10 includes an intermediate transfer belt 11 and a total of four image forming units 2 respectively corresponding to colors of yellow (Y), magenta (M), cyan (C), and black (K). Below and along the intermediate transfer belt 11, the four image forming units 2 of yellow, magenta, cyan, and black are arranged in this order starting on the left side of FIG. 1. Each image forming unit 2 includes a photoreceptor drum 3 drivingly rotated in the clockwise direction as seen in FIG. 1. Around the photoreceptor drum 3, a charger 4, an exposing unit 5, a developer 6, a primary transfer roller 7, and a photoreceptor cleaner 8 are arranged in this order in the rotation direction of the photoreceptor drum 3 (in the clockwise direction as seen in FIG. 1). For the sake of description, in FIG. 1, the image forming units 2 are respectively labeled with symbols Y, M, C, and K in accordance with reproduced colors. Also for simplicity, the components, such as the photoreceptor drum 3, of the image forming unit 2Y, for yellow, are labeled with reference numerals 3 to 8, while the components of the other image forming unit, 2M to 2K, are not labeled with reference numerals 3 to 8.

The intermediate transfer belt 11, which is another exemplary image carrier, is looped around a driving roller 12, a driven roller 13, and a tension roller 14. The intermediate transfer belt 11 drivingly rotates in the anti-clockwise direction as seen in FIG. 1. A secondary transfer roller 25, which is a component of the feeder 20, is disposed on the outer peripheral side of a portion of the intermediate transfer belt 11 wound around the driving roller 12. The intermediate transfer belt 11 and the secondary transfer roller 25 define, at the portion of their contact, a secondary transfer portion 15. A transfer belt cleaner 16 is disposed on the outer peripheral side of a portion of the intermediate transfer belt 11 wound around the driven roller 13. The transfer belt cleaner 16 removes un-transferred toner on the intermediate transfer belt 11.

The feeder 20 includes a plurality of (two in FIG. 1) sheet feed cassettes 21 and 22, feeding rollers 22*a* and 22*b*, a pair of conveyance rollers 23*a* and a pair of conveyance rollers 23*b*, a pair of timing rollers 24, and the secondary transfer roller 25. The sheet feed cassettes 21 and 22 each accommodate sheets of recording media P. The feeding rollers 22*a* and 22*b* feed the sheets of recording media P one at a time respectively from the sheet feed cassettes 21*a* and 22*b* to a main conveyance path R0. The pair of conveyance rollers 23*a* and the pair of conveyance rollers 23*b* convey the fed sheet of recording media P. The pair of timing rollers 24 determine the timing at which to feed the sheet of recording media P to the secondary transfer portion 15. A sheet of recording media P from the sheet feed cassette 21*a* is sent to the main conveyance path R0 through a first sheet feed path R1 by the driving rotation of the feed roller 22*a* and the pair of conveyance rollers 23*a*. A sheet of recording media P from the second sheet feed cassette 21*b* is sent to the main conveyance path R0 through the first and the second sheet feed paths R1 and R2 by the driving rotation the feed roller 22*b* and the pair of first conveyance rollers 23*a* and the pair of second conveyance rollers 23*b*. The second sheet feed path R2 joins the first sheet feed path R1 on the upstream side of the pair of first conveyance rollers 23*a*. The first sheet feed path R1 joins the main conveyance path R0 on the upstream side of the pair of timing rollers 24.

The fixing unit 30 includes a fixing roller 31 and a pressure roller 32. The fixing roller 31 incorporates a fixing heater 33 such as a halogen lamp. The pressure roller 32 is opposite the fixing roller 31. The fixing roller 31 and the pressure roller 32 define, at the portion of their contact, a fixing position. The controller 60 controls power to the fixing heater 33 to keep the fixing heater 33 at a temperature necessary for the fixing.

The circulation unit 40 includes a pair of reversing rollers 41, a pair of discharging rollers 42, and a plurality of pairs of duplex conveyance rollers 43 to 46. The pair of reversing rollers 41 and the pair of discharging rollers 42 serve as a plurality of reversing units to reverse a sheet of recording media P having one surface printed. In duplex mode, the circulation unit 40 reverses the sheet of recording media P printed on one surface and conveys the reversed sheet of recording media P again to the pair of timing rollers 24 through a circulation path R3, so as to have the sheet of recording media P printed on the other surface. The pair of reversing rollers 41 and the pair of discharging rollers 42 are each rotatable back and forth so as to discharge the sheet of recording media P to outside the printer 1 and to switch (feed in the backward direction) the sheet of recording media P back into the printer 1. At upper portions of the printer 1, a container tray 51 dedicated to the pair of reversing rollers 41 and the output tray 52 dedicated to the pair of discharging rollers 42 are disposed. Among the pair of reversing rollers 41 and the pair of discharging rollers 42, which serve as the reversing units, the pair of discharging rollers 42 also serve as a discharging unit to discharge a printed sheet of recording media P. The printed sheet of recording media P is discharged onto the output tray 52 by the driving rotation of the pair of discharging rollers 42. It is matter of course that the printed sheet of recording media P may be discharged on the container tray 51 by the driving rotation of the pair of reversing rollers 41.

The main conveyance path R0 at its distal end is branched into a first reversing path R4 and a second reversing path R5. The first reversing path R4 is led to the pair of reversing rollers 41, while the second reversing path R5 is led to the pair of discharging rollers 42. At the portion where the main conveyance path R0 is branched, a path switch gate 47 serving as a switching member is disposed to switch the sheet of recording media P between the pair of reversing rollers 41 and the pair of discharging rollers 42. A solenoid 63 is coupled to the controller 60, and when excited, drivingly switches the path switch gate 47 between the cut-off state of the route to the second reversing path R5 (that is, the state in which the sheet of recording media P is guided from the main conveyance path R0 to the first reversing path R4) and the cut-off state of the route to the first reversing path R4 (that is, the state in which the sheet of recording media P is guided from the main conveyance path R0 to the second reversing path R5).

The circulation path R3 at its beginning end is branched into a first branch path R6 and a second branch path R7. The first branch path R6 is continuous to the first reversing path R4, while the second branch path R7 is continuous to the second reversing path R5. The sheet of recording media P switched back from the first reversing path R4 through the pair of reversing rollers 41 is conveyed to the circulation path R3 through the first branch path R6. The sheet of recording media P switched back from the second reversing path R5 through the pair of discharging rollers 42 is conveyed to the circulation path R3 through the second branch path R7. The circulation path R3 at its distal end joins the main conveyance path R0 at the upstream side of the pair of timing rollers 24. In this embodiment, the sum of the path lengths of the first reversing path R4 and the first branch path R6 is equal to the sum of the path lengths of the second reversing path R5 and the second branch path R7 (R4+R6=R5+R7).

Figure 2:
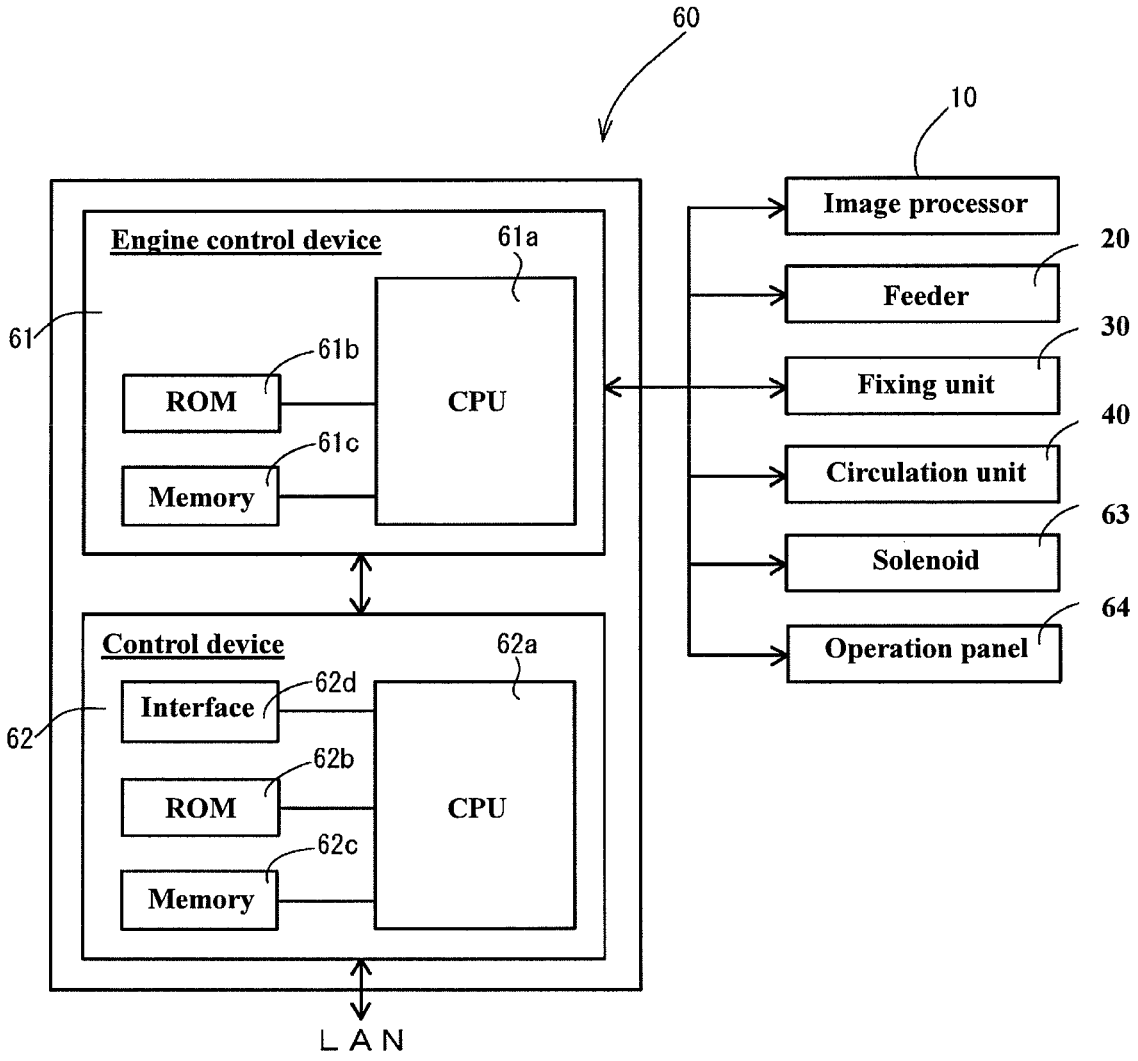
FIG. 2 is a functional block diagram of a controller.

The controller 60 receives an image signal transmitted from an external terminal (not shown), converts the image signal into digital image data for Y, M, C, and K, and controls the operational units, such as the image processor 10 and the feeder 20, so as to print the digital image data. The controller 60 according to this embodiment is disposed in the printer 1 between the image processor 10 and the first sheet feed cassette 21*a*. As shown in FIG. 2, the controller 60 mainly includes an engine control device 61 and a control device 62. The engine control device 61 and the control device 62 are capable of exchanging data including various signals.

The control device 62 includes a CPU 62*a*, a ROM 62*b*, a memory 62*c*, and an interface (I/F) 62*d*. The control device 62 outputs a printing-associated command signal to the engine control device 61 at an appropriate timing. The command signal indicates, for example, which image data is to be printed on which surface of which sheet. The engine control device 61 includes a CPU 61*a*, a ROM 61*b*, and a memory 61*c*. Upon receipt of a command signal from the control device 62, the engine control device 61 controls the operational units, such as the image processor 10 and the feeder 20, so as to execute a printing operation based on the command signal. For example, when the received command signal is concerning printing of the first sheet of recording media P, the engine control device 61 controls the first sheet of recording media P to be picked up from the sheet feed cassette 21*a* or 21*b* and printed on one surface. In duplex mode, the engine control device 61 further controls the first sheet of recording media P, which is now printed on one surface, to return to the main conveyance path R0 through the first reversing path R4, the first branch path R6, and the circulation path R3, so as to have the first sheet of recording media P printed on the other surface. During printing operations, the engine control device 61 directly controls the behavior of the operational units involved in printing, such as the image processor 10 and the feeder 20. For example, the engine control device 61 controls the driving source to drivingly rotate the rollers, and controls the fixing heater 33 to turn into ON state.

Thus, the controller 60 according to this embodiment can be regarded as dividable into the control device 62, which makes a command for a printing operation, and the engine control device 61, which executes the printing operation based on the command. The control device 62 stores a program for making a printing command. For example, the program is associated with the feeding timing and the printing order, which are part of the control necessary for determining an actual circulated sheet number C, described later. The engine control device 61 stores a program for controlling the operational units in accordance with the command signal from the control device 62. This ensures that the engine control device 61 and the control device 62 each take on a share of the program (firmware) functions, resulting in facilitated firmware design. Additionally, when a need for a change arises in, for example, the sheet feed timing, all that is necessary is to change the program stored in the control device 62, thus making the firmware design readily changeable.

In the engine control device 61, the program for controlling the operational units is stored in the ROM 61*b*. The CPU 61*a* reads the program from the ROM 61*b* to control a printing operation. The memory 61*c* serves as a working area in which the CPU 61*a* executes the program. In the control device 62, the program for making a command to the engine controller 61 is stored in the ROM 62*b*. The CPU 62*a* reads the program from the ROM 62*b* and outputs a command signal for a printing operation to the engine control device 61. The memory 62*c* serves as a working area in which the CPU 62*a* executes the program. The interface 62*d* is used for coupling to a network such as a LAN.

In simplex mode, a sheet of recording media P is printed in the following manner. In each of the image forming units 2Y to 2K, the photoreceptor drum 3 is cleaned by the photoreceptor cleaner 8 and uniformly charged by the charger 4. The charged photoreceptor drum 3 is irradiated with light from the exposing unit 5, thereby forming an electrostatic latent image on the surface of the photoreceptor drum 3. The electrostatic latent image is reverse-developed using toner from the developer 6 and visualized into a toner image of the corresponding color. The toner images of yellow, magenta, cyan, and black on the photoreceptor drums 3 are primary transferred in the order set forth to the intermediate transfer belt 11 on the primary transfer rollers 7, so that the toner images are superimposed onto each other on the intermediate transfer belt 11. Meanwhile, a sheet of recording media P is conveyed to a secondary transfer portion 15 through the pair of timing rollers 24 at the timing when the color toner images move to the secondary transfer portion 15 by the driving rotation of the intermediate transfer belt 11. The superimposed toner images of the four colors are collectively secondary transferred onto one surface of the sheet of recording media P that is passing through the secondary transfer portion 15. After the secondary transfer, the intermediate transfer belt 11 is cleaned by the transfer belt cleaner 12. The sheet of recording media P past the secondary transfer portion 15 with an unfixed toner image on one surface is heated and pressed through the fixing portion of the fixing portion 30. Thus, the unfixed toner image is fixed on the sheet of recording media P. At the start of the fixing, the path switch gate 47 is drivingly switched to open the second reversing path R5 and close the first reversing path R4. The sheet of recording media P having one surface fixed (printed) is discharged onto the output tray 52 by the driving rotation of the pair of discharging rollers 42.

In duplex mode, a sheet of recording media P is printed in the following manner. At the start of printing on one surface, the path switch gate 47 is drivingly switched to close the second reversing path R5 and open the first reversing path R4. After the printing on one surface, the sheet of recording media P is conveyed to the first reversing path R4. Immediately before the rear end of the sheet of recording media P passes through the pair of reversing rollers 41, the pair of reversing rollers 41 rotate in reverse to switch back the sheet of recording media P printed on one surface. The sheet of recording media P is guided to the circulation path R3 through the first branch path R6 in reversed state relative to the image processor 10. The sheet of recording media P conveyed to the circulation path R3 is returned to the main conveyance path R0 by the driving rotation of the pairs of duplex conveyance rollers 43 to 46, and transferred again to the secondary transfer portion 15 by the driving rotation of the pair of timing rollers 24. In conjunction with the circulation, the image processor 10 executes various kinds of processing including primary transfer of toner images of the four colors to be printed on the other surface of the re-fed sheet of recording media P. Then, the toner images of the four colors superimposed on the intermediate transfer belt 11 are collectively secondary transferred onto the other surface of the sheet of recording media P that is passing through the secondary transfer portion 15. The sheet of recording media P loaded with an unfixed toner image on the other surface is subjected to fixing processing at the fixing unit 30. Then, the second reversing path R5 is opened by the driving switching of the path switch gate 47, and the sheet of recording media P having the other surface fixed (now having both surfaces printed) is discharged onto the output tray 52 through the open second reversing path R5 by the driving rotation of the pair of discharging rollers 42.

In duplex mode, when duplex printing a plurality of sheets of recording media P consecutively, the printer 1 uses its circulating duplex printing function to group a predetermined circulated sheet number Cs, among the plurality of sheets of recording media P, into one unit for one-surface printing and the other-surface printing, and to repeat the one-surface printing and the other-surface printing on a predetermined circulated sheet number Cs basis. For example, assume that the predetermined circulated sheet number Cs is four. In this case, four sheets of recording media P are first subjected to one-surface printing consecutively, next circulated and reversed, and then subjected to the other-surface printing consecutively (see FIGS. 4A to 4I and FIGS. 5A to 5I). The predetermined circulated sheet number Cs refers to the maximum number of sheets of recording media P simultaneously containable in the circulation path (the main conveyance path R0, the circulation path R3, the reversing paths R4 and R5, and the branch paths R6 and R7). The predetermined number of circulated sheet Cs is basically determined based on an entire path length Rt in relation to a conveyance direction length L of the recording media P. The entire path length Rt is set based on the circulation of most frequently used recording media P, namely, A4 in portrait. In this embodiment, the predetermined circulated sheet number Cs for A4 in portrait (where the recording media P has a conveyance direction length L of 210 mm) is five, and the entire path length Rt is so set to direct highest duplex productivity to the circulation of five sheets of recording media P of A4 in portrait. The entire path length Rt according to this embodiment is represented as (R0+R3+R4+R6) or (R0+R3+R5+R7).

Depending on the conveyance direction length L of the recording media P in relation to the entire path length Rt, the duplex productivity in the circulation of four sheets, three sheets, or two sheets becomes approximately equivalent to the simplex productivity. FIG. 3 shows this relationship in the form of table T for the circulated sheet number. Specifically, when the conveyance direction length L of the recording media P is 294 mm, the duplex productivity in the circulation of four sheets is approximately as high as the simplex productivity. When the conveyance direction length L of the recording media P is 378 mm, the high duplex productivity is obtained in the circulation of three sheets. When the conveyance direction length L of the recording media P is 462 mm, the high duplex productivity is obtained in the circulation of two sheets. In view of this, in this embodiment, four conveyance direction lengths including the conveyance direction length (=210 mm) of A4 in portrait are employed as predetermined lengths Ls corresponding to predetermined circulated sheet numbers Cs (2 to 5) and are used as parameters to determine an actual circulated sheet number C, described later. The parameters are listed in the circulated sheet number table T in FIG. 3. The circulated sheet number table T shown in FIG. 3 is stored in the ROM 62*b* of the control device 62.

This embodiment includes two types of duplex modes, namely, normal duplex mode and transposing duplex mode. In normal duplex mode, the recording media P is switched back using the pair of reversing rollers 41 alone (see FIGS. 4A to 4I). In transposing duplex mode, the recording media P is switched back using the pair of reversing rollers 41 and the pair of discharging rollers 42 (see FIGS. 5A to 5I).

FIGS. 4A to 4I schematically show the order of printing a plurality of sheets of recording media P in normal duplex mode. The example shown in FIGS. 4A to 4I is where the conveyance direction length L of the recording media P is 294 mm, which is one of the predetermined lengths Ls (where the predetermined circulated sheet number Cs=4). For the sake of description, the reference sign P of the sheets of recording media P will be followed by a numerical indication where necessary in FIGS. 4A to 4I and 5A to 5I in order to indicate the feeding order of the sheets of recording media P. For example, the sheet of recording media P first to be fed is indicated P1, and the second sheet of recording media P is indicated P2. Also in FIGS. 4A to 4I and 5A to 5I, a numerical-alphabetical indication is provided on one and/or the other surface of each sheet of recording media P in order to indicate the order of the corresponding image in relation to on which surface of the sheet of recording media P the image is to be printed, as included in a printing command from an external terminal. For example, 1-A indicates the first image to be printed on one surface, and 2-B indicates the second image to be printed on the other surface.

In normal duplex mode shown in FIGS. 4A to 4I, the path switch gate 47 is drivingly switched to open the first reversing path R4, and a sheet of recording media P1, which is the first in the feeding order, is subjected to one-surface printing 1-A of a first image (see FIG. 4A). Then, a sheet of recording media P2 is subjected to one-surface printing 2-A of a second image, a sheet of recording media P3 is subjected to one-surface printing 3-A of a third image, and a sheet of recording media P4 is subjected to one-surface printing 4-A of a fourth image (see FIGS. 4B to 4D). The sheet of recording media in each case is switched back at the pair of reversing rollers 41. Then, the path switch gate 47 is drivingly switched to open the second reversing path R5 (see FIG. 4E), and the first sheet of recording media P1 is subjected to other-surface printing 1-B of a first image, the second sheet of recording media P2 is subjected to other-surface printing 2-B of a second image, the third sheet of recording media P3 is subjected to other-surface printing 3-B of a third image, and the fourth sheet of recording media P4 is subjected to other-surface printing 4-B of a fourth image, in the order set forth (see FIGS. 4E to 4I). Thus, the order of feeding and printing is P1=1-A, P2=2-A, P3=3-A, P4=4-A, P1=1-B, P2=2-B, P3=3-B, P4=4-B. The sheets of recording media P1 to P4, which are now printed on the other surfaces (that is, printed on both surfaces), are discharged onto the output tray 52 in the image order from between the pair of discharging rollers 42. The image order corresponds to the feeding order of the recording media P (for example, the sheet of recording media P1 is subjected to 1-A and 1-B).

FIGS. 5A to 5I schematically show the order of printing a plurality of sheets of recording media P in transposing duplex mode. The example shown in FIGS. 5A to 5I is where the conveyance direction length L of the sheet of recording media P is 297 mm (A4 in landscape). Since the 297 mm conveyance direction length L is 3 mm longer than the predetermined length Ls=294 mm, the predetermined circulated sheet number Cs is set at three. It should be noted, however, that in transposing duplex mode, one sheet of recording media P is temporarily held at the pair of reversing rollers 41 (which is a holding reversing unit) so as to make the actual circulated sheet number C of the circulated recording media P larger, by one, than the predetermined circulated sheet number Cs (=3) (that is, the actual circulated sheet number C is four).

Figure 5:
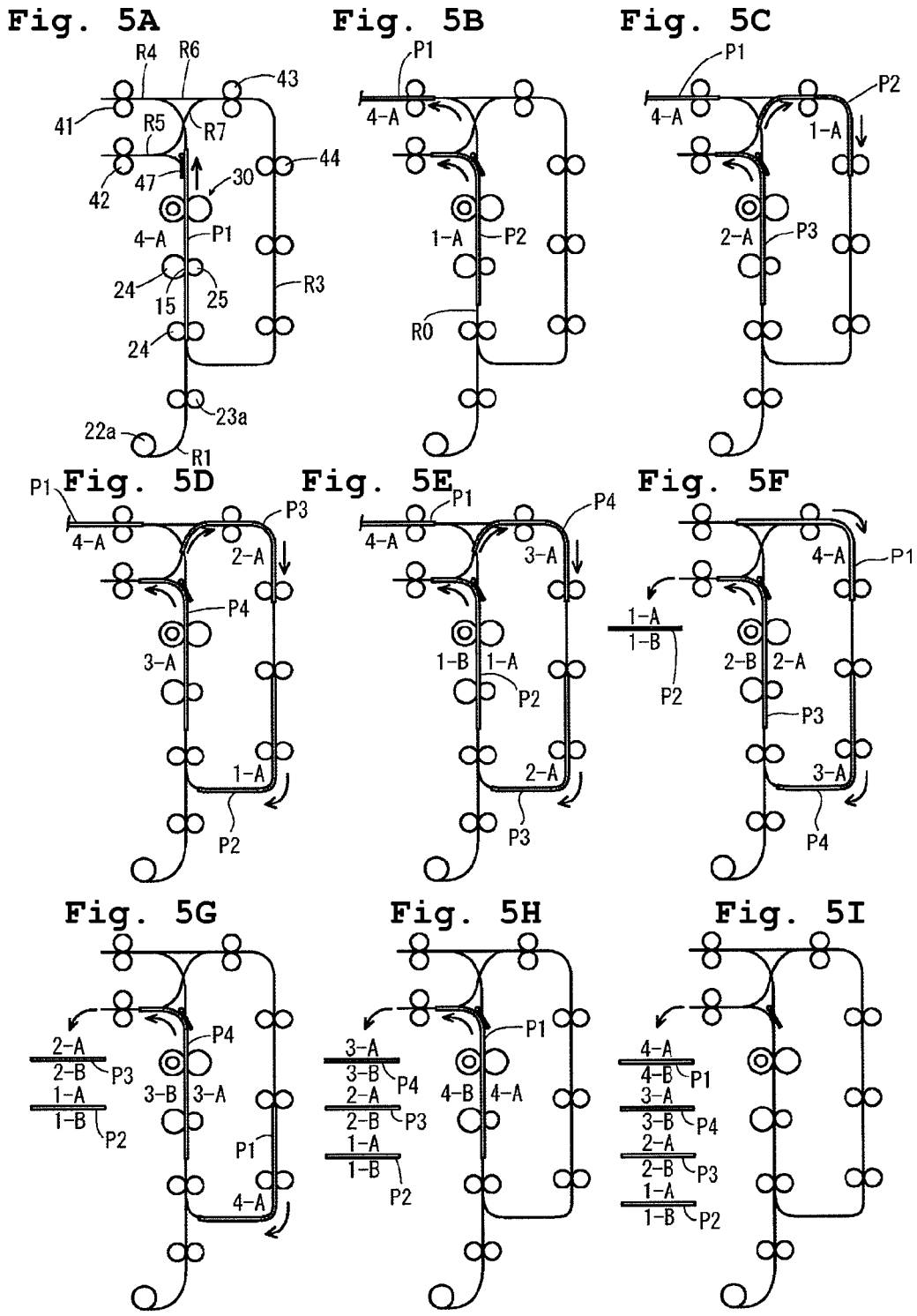
FIGS. 5A to 5I are diagrams illustrating an order of printing a plurality of sheets of recording media in transposing duplex mode.

In transposing duplex mode shown in FIGS. 5A to 5I, the path switch gate 47 is drivingly switched to open the first reversing path R4, and a sheet of recording media P1, which is the first in the feeding order, is subjected to one-surface printing 4-A of a fourth image (see FIG. 5A). Then, with the sheet of recording media P1 held at the pair of reversing rollers 41 instead of being switched back, the path switch gate 47 is drivingly switched to open the second reversing path R5, and the second sheet of recording media P2 is subjected to one-surface printing 1-A (see FIG. 5B) of a first image. Subsequently, with the sheet of recording media P1 held at the pair of reversing rollers 41, the sheet of recording media P2 is switched back at the pair of discharging rollers 42 and guided to the circulation path R3 through the second branch path R7. In conjunction to this operation, the sheet of recording media P3 is subjected to one-surface printing 2-A of a second image (see FIG. 5C). Then, the sheet of recording media P3 is switched back at the pair of discharging rollers 42 and guided to the circulation path R3 through the second branch path R7, while the sheet of recording media P4 is subjected to one-surface printing 3-A of a third image (see FIG. 5D).

Then, the sheet of recording media P2 is subjected to other-surface printing 1-B of a first image, the sheet of recording media P3 is subjected to other-surface printing 2-B of a second image, and the sheet of recording media P4 is subjected to other-surface printing 3-B of a third image, in the order set forth. The sheets of recording media P2 to P4 are then discharged onto the output tray 52 by the driving rotation of the pair of timing rollers 24 (see FIGS. 5E to 5H). After the one-surface printing 3-A, the sheet of recording media P4 is guided to the circulation path R3, and the sheet of recording media P1 in held state is switched back by the pair of reversing rollers 41 and subjected to other-surface printing 4-B of a fourth image. Then, the sheet of recording media P1 is discharged onto the output tray 52 (see FIGS. 5F to 5I). The image order (printing order) does not correspond to the feeding order of the sheets of recording media P; instead, the image order is transposed. This is for the purpose of discharging the sheets of recording media P according to the image order (that is, for the purpose of agreement between the image order and the discharge order of the sheets of recording media P). Specifically, the order of feeding and printing is P1=4-A, P2=1-A, P3=2-A, P4=3-A, P2=1-B, P3=2-B, P4=3-B, P1=4-B.

Figures 6A, 6B:
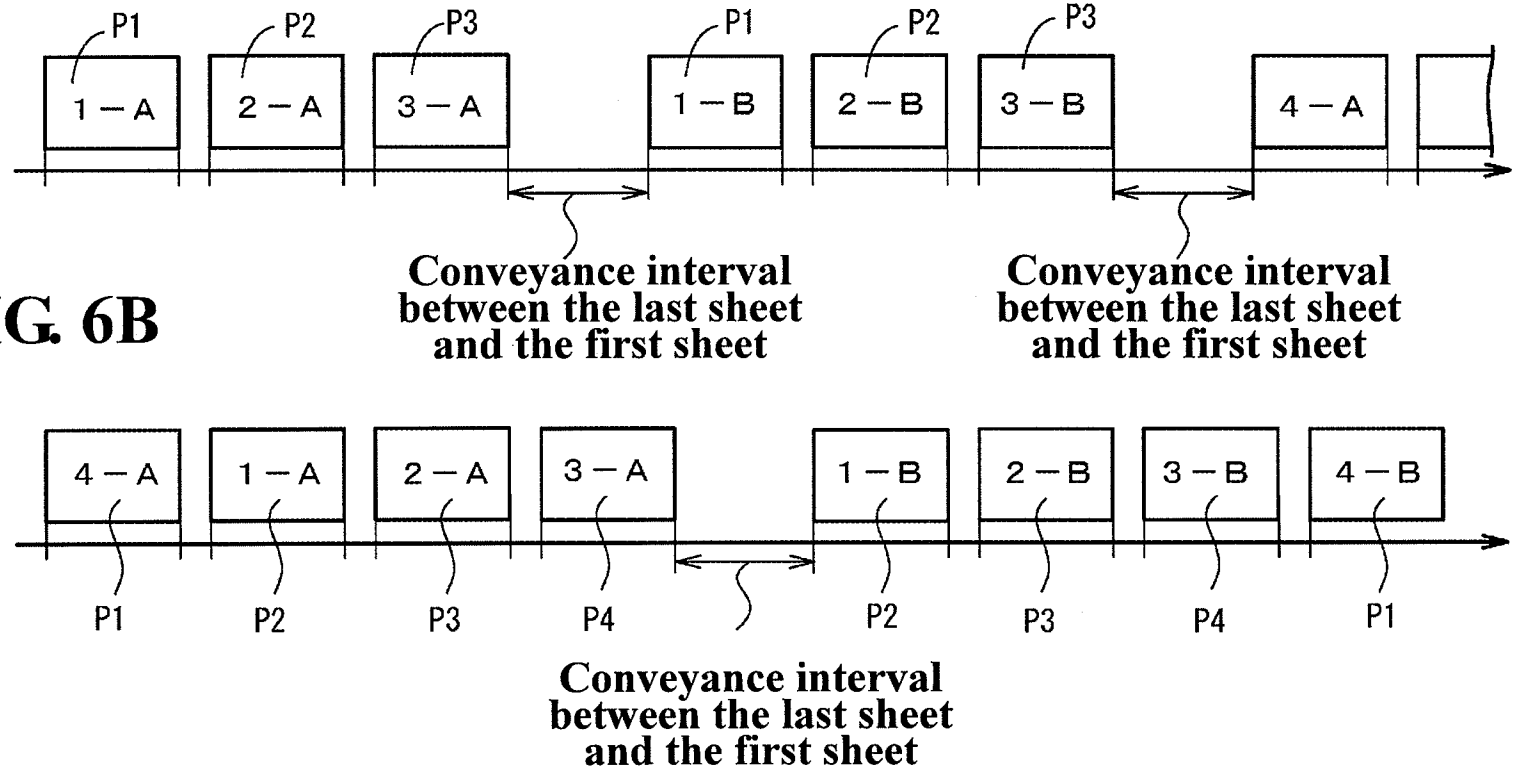
FIG. 6A is a timing chart of the normal duplex mode shown in FIGS. 4A to 4I.
FIG. 6B is a timing chart of the transposing duplex mode executed in a same condition as in FIGS. 4A to 4I.

FIGS. 6A and 6B show timing charts in duplex mode for comparison. FIG. 6B shows the transposing duplex mode of FIGS. 5A to 5I, and FIG. 6A shows the normal duplex mode with 297 mm conveyance direction length L of the recording media P (which is the same condition as the one in FIGS. 5A to 5I). That is, in FIG. 6B, the predetermined circulated sheet number Cs is set at three, as determined by the conveyance direction length L of the recording media P in relation to the predetermined length Ls. Both cases employ the same process speeds (examples including, but not limited to, the rotation of the photoreceptor drum 3).

A comparison between FIGS. 6A and 6B shows that in FIG. 6A, a large conveyance interval exists between the last sheet of recording media P3 and the first sheet of recording media P1, with a time lag (interval between conveyances) occurring after duplex printing of six sheets of recording media P. In FIG. 6B, a time lag occurs after duplex printing of eight sheets of recording media P, resulting in less frequent time lags. This increases the number of printed sheets per unit time and minimizes degradation of duplex productivity that may otherwise be caused by variations in the conveyance direction length L of the recording media P.

As described above by referring to FIGS. 5A to 5I, the controller 60 transposes the images to be printed in accordance with the discharge order of the sheets of recording media P, as determined by holding of a sheet of recording media P at the pair of reversing rollers 41. This ensures discharge of the sheets of recording media P onto the output tray 52 according to the image order, and eliminates or minimizes a mismatch between the discharge order of the sheets of recording media P and the order of the images printed on the sheets of recording media P. This, as a result, maintains user friendliness.

Figure 7:
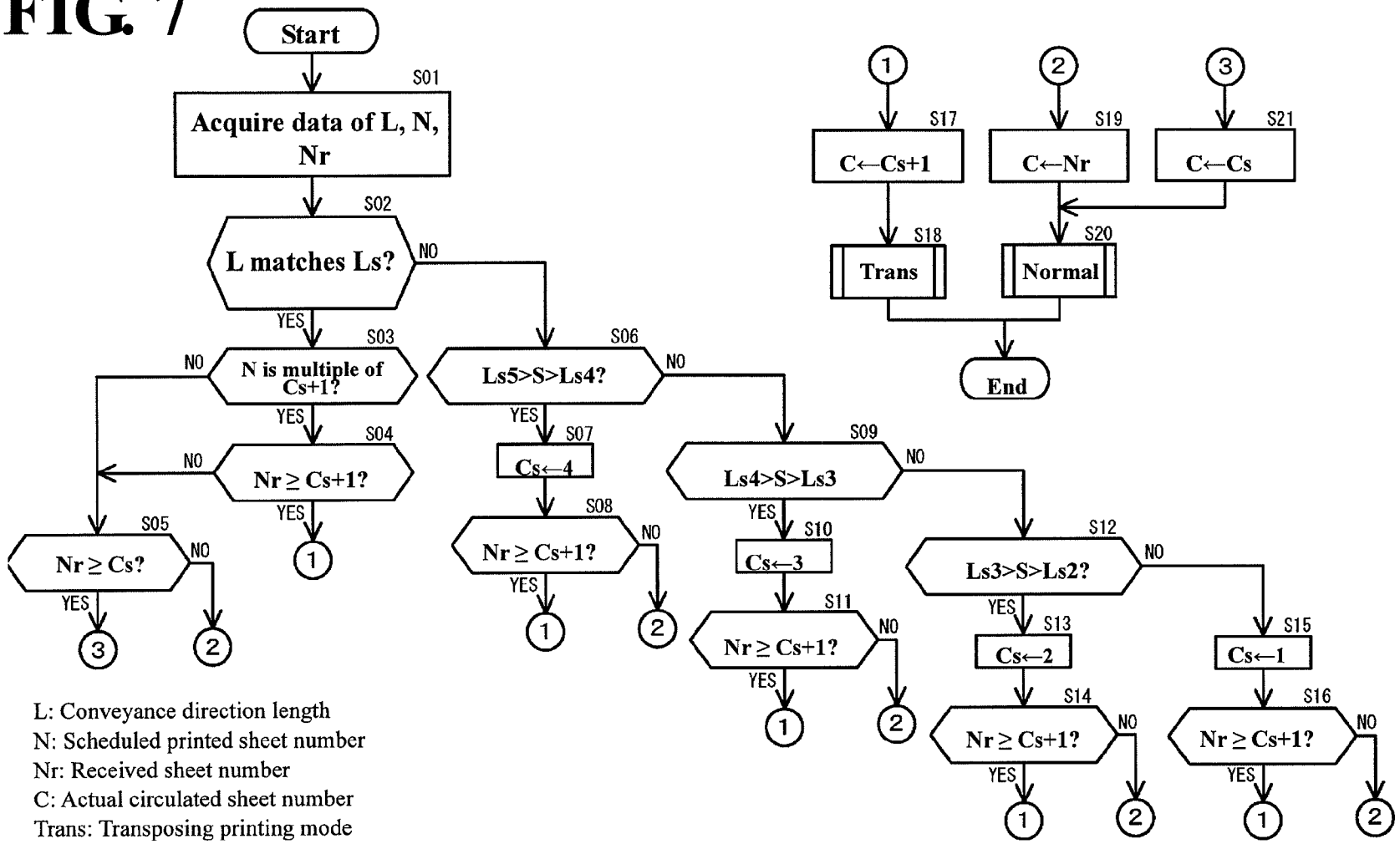
FIG. 7 is a flowchart illustrating a flow of duplex mode control.

FIG. 7 shows exemplary duplex mode control executed by the controller 60. As shown in FIG. 7, at the start of the duplex mode control, the controller 60 first acquires data of the conveyance direction length L of the recording media P, a scheduled printed sheet number N, and a received sheet number Nr, which are included in a printing command from an external terminal or other devices (S01). Then, based on the acquired data and the circulated sheet number table T, the controller 60 determines whether the conveyance direction length L of the recording media P matches any of the predetermined lengths Ls (S02). When the conveyance direction length L of the recording media P matches any of the predetermined lengths Ls (YES in S02), if the scheduled printed sheet number N is a multiple of a sum of one and the predetermined circulated sheet number Cs corresponding to the matching predetermined length Ls (YES in S03) while at the same time the received sheet number Nr is equal to or larger than Cs+1 (YES in S04), then the controller 60 sets the actual circulated sheet number C at Cs+1 (S17) and controls printing to be executed in transposing duplex mode (S18).

When the conveyance direction length L of the sheet of recording media P matches any of the predetermined lengths Ls, the duplex productivity in the circulation of a plurality of sheets of recording media P is on a level similar to the simplex productivity (which is, specifically, efficiency of consecutive simplex printing). Hence, as the actual circulated sheet number C is smaller, a greater advantage is obtained in the fast copy time (FCOT) and the memory capacity in which data is stored at a time. It should be noted, however, that when the scheduled printed sheet number N is a multiple of Cs+1, setting the actual circulated sheet number C at Cs+1 ensures a shorter printing time in total. For example, when six sheets of A4 in portrait (N=6) are duplex printed, the duplex printing ends earlier in the circulation of six sheets at a time than in the separate circulations of five sheets and one sheet. This is why this embodiment employs the above-described manner of control. It should be noted that if no data of the actual circulated sheet number C (=Cs+1) is received by the controller 60, a paper jam can occur in the course of circulation. In view of this, the control in step S04 is employed to minimize the occurrence of a paper jam that may otherwise be caused by a lack of received data.

When the conveyance direction length L of the sheet of recording media P matches any of the predetermined lengths Ls (YES in S02), if the scheduled printed sheet number N is not a multiple of Cs+1 (NO in S03) or if the received sheet number Nr is smaller than Cs+1 (NO in S04), then the controller 60 determines whether the received sheet number Nr is equal to or larger than Cs (S05). When the received sheet number Nr is smaller than Cs (NO in S05), this means that the controller 60 has not received data of the actual circulated sheet number C (=Cs). Hence, the controller 60 sets the actual circulated sheet number C at Nr (S19), and controls printing to be executed in normal duplex mode (S20). When the received sheet number Nr is equal to or larger than Cs (YES in S05), the controller 60 sets the actual circulated sheet number C at Cs (S21), and controls printing to be executed in normal duplex mode (S20).

When in step S02 the conveyance direction length L does not correspond to any of the predetermined lengths Ls (NO in S02), the controller 60 determines whether the conveyance direction length L of the recording media P is larger than the four-sheet predetermined length Ls4 and smaller than the five-sheet predetermined length Ls5 (S06). When Ls5>L>Ls4 (YES in S06), the controller 60 sets the predetermined circulated sheet number Cs at four (S07). Then, when the received sheet number Nr is equal to or larger than Cs+1 (=4+1) (YES in S08), the controller 60 sets the actual circulated sheet number C at Cs+1 (S17), and controls printing to be executed in transposing duplex mode (S18). When the received sheet number Nr is smaller than Cs+1 (NO in S08), the controller 60 sets the actual circulated sheet number C at Nr (S19), and controls printing to be executed in normal duplex mode (S20).

When Ls5>L>Ls4 does not hold true in step S06 (NO in S06), the controller 60 determines whether the conveyance direction length L of the recording media P is larger than the three-sheet predetermined length Ls3 and smaller than the four-sheet predetermined length Ls4 (S09). When Ls3>L>Ls4 (YES in S09), the controller 60 sets the predetermined circulated sheet number Cs at three (S10). Then, when the received sheet number Nr is equal to or larger than Cs+1 (=3+1) (YES in S11), the controller 60 sets the actual circulated sheet number C at Cs+1 (S17), and controls printing to be executed in transposing duplex mode (S18). When the received sheet number Nr is smaller than Cs+1 (NO in S11), the controller 60 sets the actual circulated sheet number C at Nr (S19), and controls printing to be executed in normal duplex mode (S20).

When Ls4>L>Ls3 does not hold true in step S09 (NO in S09), the controller 60 determines whether the conveyance direction length L of the recording media P is larger than the two-sheet predetermined length Ls2 and smaller than the three-sheet predetermined length Ls3 (S12). When Ls3>L>Ls2 (YES in S12), the controller 60 sets the predetermined circulated sheet number Cs at two (S13). When the received sheet number Nr is equal to or larger than Cs+1 (=2+1) (YES in S14), the controller 60 sets the actual circulated sheet number C at Cs+1 (S17), and controls printing to be executed in transposing duplex mode (S18). When the received sheet number Nr is smaller than Cs+1 (NO in S14), the controller 60 sets the actual circulated sheet number C at Nr (S19), and controls printing to be executed in normal duplex mode (S20).

When Ls3>L>Ls2 does not hold true in step S12 (NO in S12), the controller 60 sets the predetermined number of circulated sheet at one (S15). When the received sheet number Nr is equal to or larger than Cs+1 (=1+1) (YES in S16), the controller 60 sets the actual circulated sheet number C at Cs+1 (S17), and controls printing to be executed in transposing duplex mode (S18). When the received sheet number Nr is smaller than Cs+1 (NO in S16), the controller 60 sets the actual circulated sheet number C at Nr (S19), and controls printing to be executed in normal duplex mode (S20).

Figure 8:
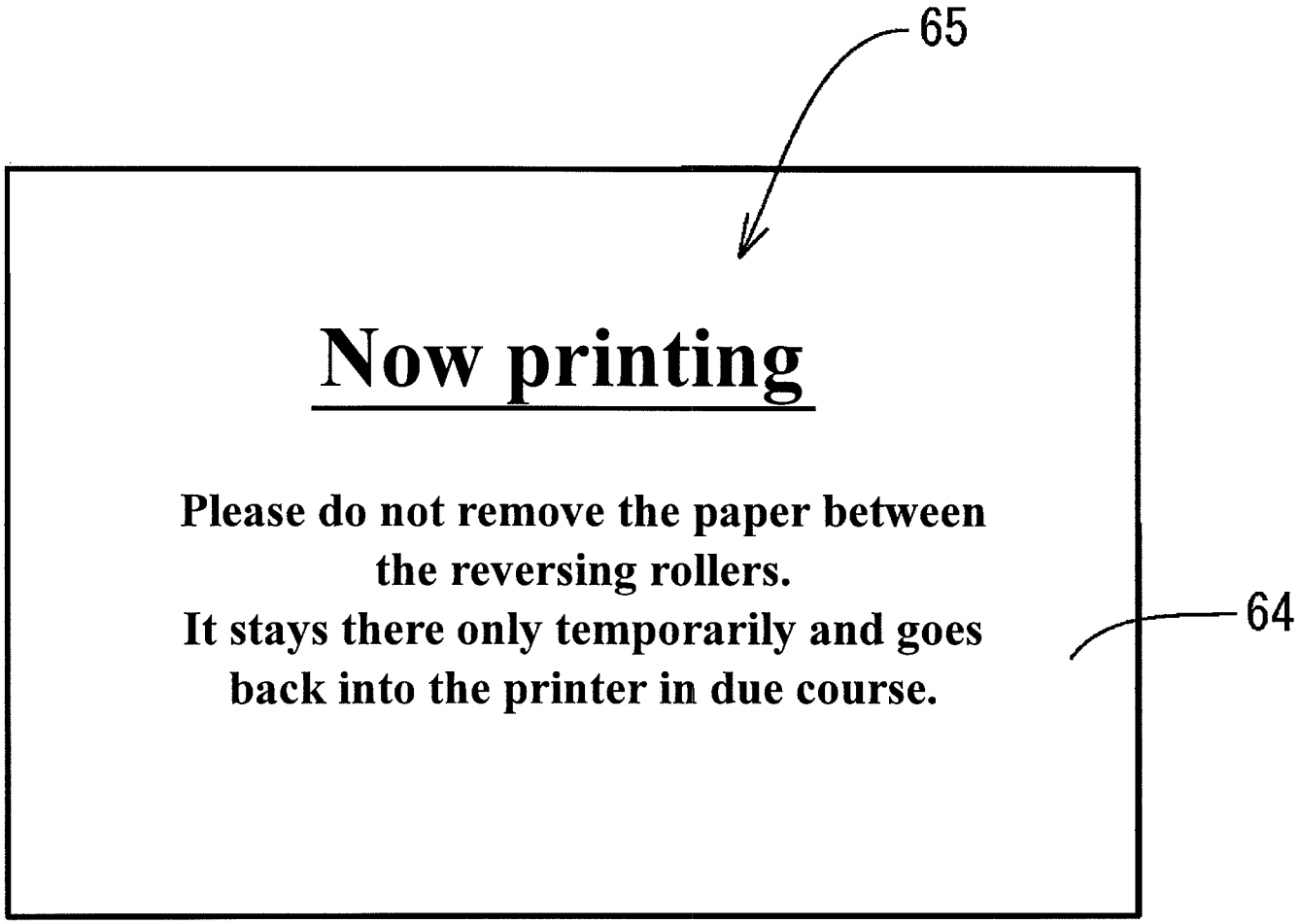
FIG. 8 is a diagram illustrating prohibition information displayed on an operation panel during temporal holding of a sheet of recording media.

In transposing duplex mode, the sheet of recording media P temporarily held at the pair of reversing rollers 41 is exposed to outside the printer 1 for a long period of time. In view of this, in this embodiment, an operation panel 64 (see FIG. 2) serving as a notifier is electrically coupled to the controller 60 so as to display a notification to prohibit removal of the temporarily held sheet of recording media P while the sheet of recording media P is exposed to outside. This provides a warning to the user to prevent accidental pulling of the temporarily held sheet of recording media P. In the meantime, the operation panel 64 displays, for example, prohibition information 65 as shown in FIG. 8. When the temporarily held sheet of recording media P is switched back, the prohibition information 65 is un-displayed and the operation panel 64 returns to normal state of display.

Figure 9:
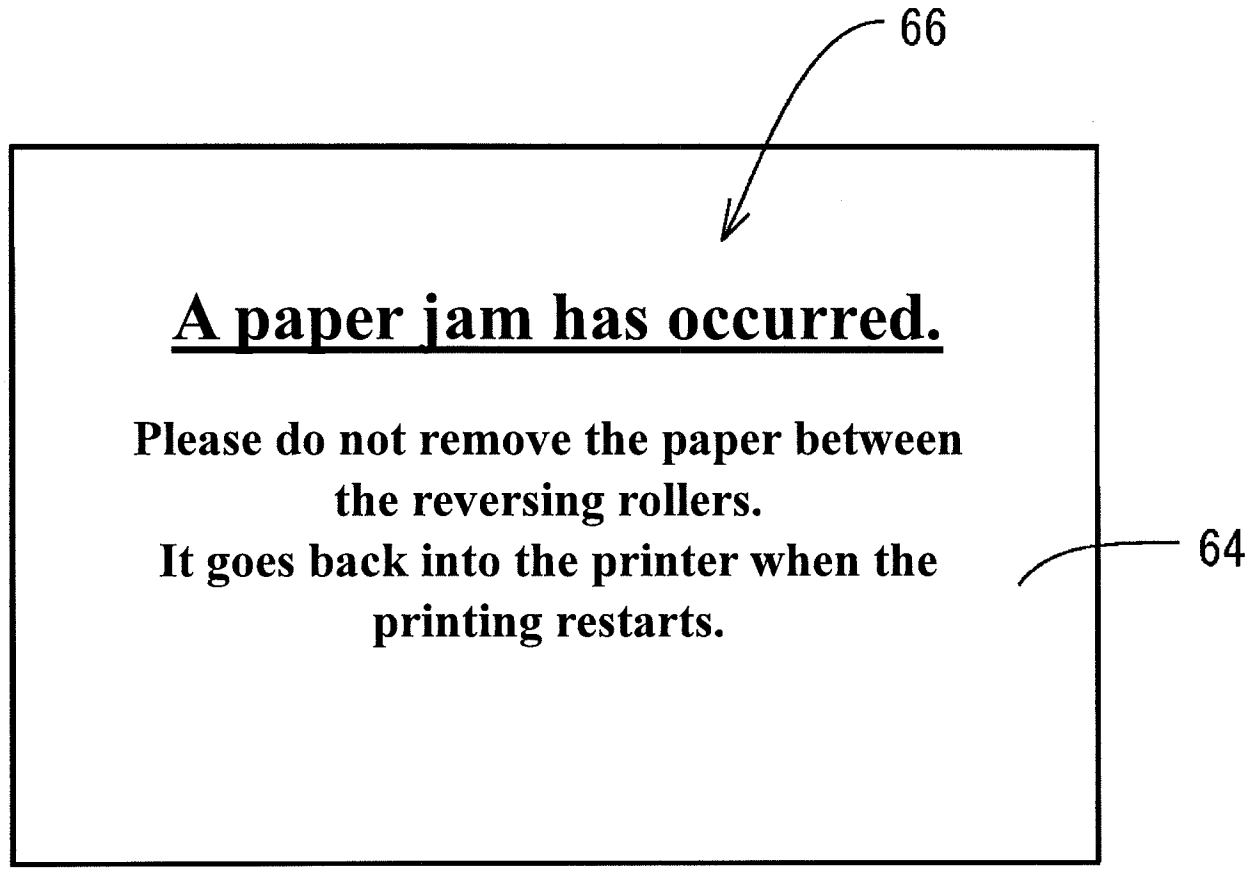
FIG. 9 is a diagram illustrating prohibition information displayed on the operation panel during a paper jam.

When a paper jam occurs in the printer 1 while the sheet of recording media P is temporarily held at the pair of reversing rollers 41, damage to the sheet of recording media P is eliminated or minimal, which eliminates the need for replacing the temporarily held sheet of recording media P. In view of this, in this embodiment, the operation panel 64 displays a notification to prohibit removal of the temporarily held sheet of recording media P until the paper jam is cleared. This provides a warning to the user to prevent accidental pulling of the temporarily held sheet of recording media P. This also saves a waste of sheets of recording media P that need not be replaced. In the meantime, the operation panel 64 displays, for example, prohibition information 66 as shown in FIG. 9. When the paper jam is cleared, the prohibition information 66 is un-displayed and the operation panel 64 returns to normal state of display.

The controller 60 according to this embodiment prohibits the pair of reversing rollers 41 from holding the sheet of recording media P when during a printing operation, a change is made to any of printing conditions including the conveyance direction length of the recording media P, the paper type of the recording media P, the printing mode, and the process speed. In other words, the controller 60 is capable of interruption processing to prohibit the transposing duplex mode. The controller 60 executes the interruption processing at appropriate time intervals during the duplex mode control.

Figure 10:
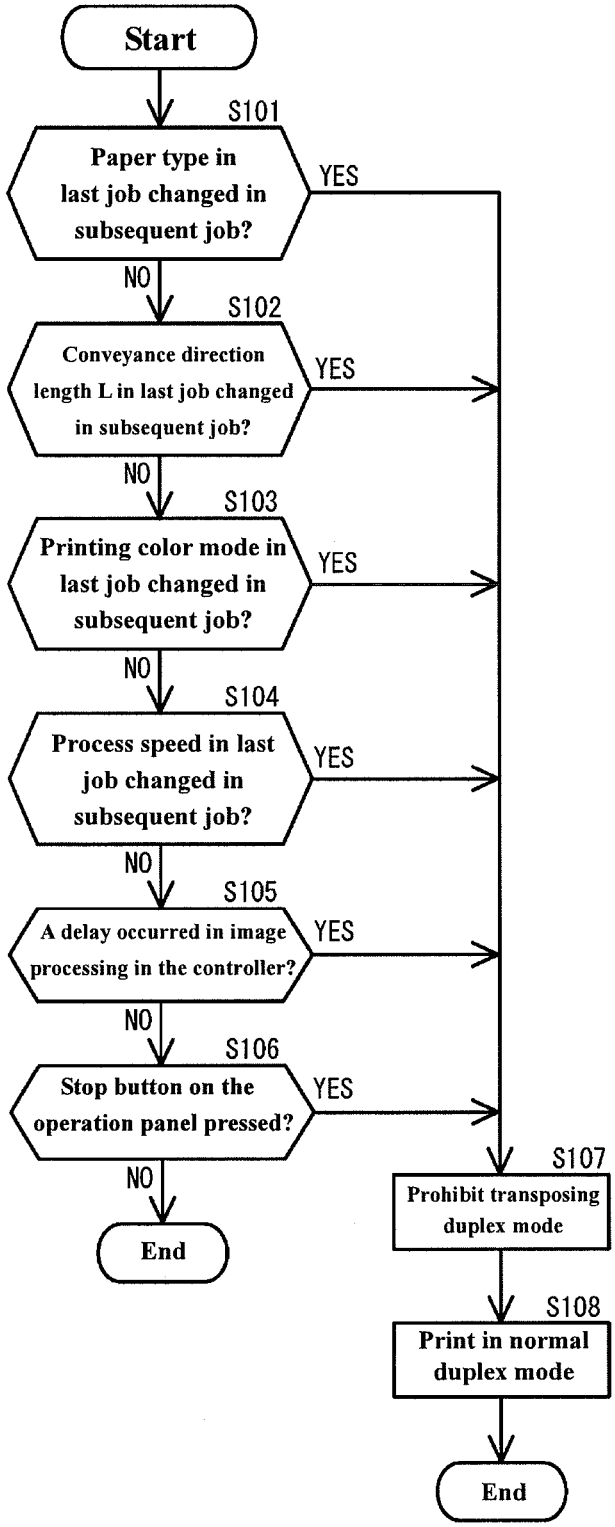
FIG. 10 is a flowchart illustrating a flow of interruption processing.

For example, as shown by the flowchart in FIG. 10, the paper type (including plain paper, cardboard, and coated paper) of the recording media P used in the last job may be changed in the subsequent job by switching between the sheet feed cassettes 21*a* and 21*b* (YES in S101), or there may be a difference in conveyance direction length L between the recording media P used in the last printing job and the recording media P used in the subsequent printing job (YES in S102). In these cases, the controller 60 forcibly prohibits printing in transposing duplex mode (S107) and controls printing to be executed in normal duplex mode (S108).

Also when there is a difference in printing color mode between the last and subsequent printing jobs (YES in S103), or when the process speed in the last printing job is changed in the subsequent printing job (YES in S104), then the controller 60 forcibly prohibits printing in transposing duplex mode (S107) and controls printing to be executed in normal duplex mode (S108). The printing color modes are roughly classified into a monochrome mode and a color mode. Additionally, when an image signal of a size far exceeding the memory capacity is received and thereby a delay is caused in image processing such as image data conversion (YES in S105), or when a stop button on the operation panel 64 is pressed (YES in S106), then the controller 60 forcibly prohibits printing in transposing duplex mode (S107) and controls printing to be executed in normal duplex mode (S108).

The above-described changes to the printing conditions during a printing operation mean changes to the conditions initially expected. This can cause, for example, reduction in the printing speed of each individual sheet of recording media and other occurrences during a printing operation in transposing duplex mode. This, in turn, can inhibit the increase in the number of printed sheets per unit time and cause degradation of the duplex productivity. This is why this embodiment employs the above-described manner of control, which saves a waste of control.

The present invention is not limited to the above-described embodiment and can be embodied in various forms. For example, while a printer has been described as an exemplary image forming apparatus, this should not be construed in a limiting sense. Other possible examples include copiers, fax machines, and multi-function machines integrally incorporating copy and fax capabilities. While in the above-described embodiment two reversing units are used (namely, the pair of reversing rollers 41 and the pair of discharging rollers 42), this should not be construed in a limiting sense. It is also possible to use three or more reversing units. The circulating duplex printing function may employ the "duplex alternate circulation method", by which a sheet of recording media P is duplex printed and then the next sheet of recording media P is duplex printed.

Thus, in the above-described embodiment, during duplex printing of a plurality of sheets of recording media P through circulation in the circulation unit 40, the pair of reversing rollers 41 hold at least one sheet among the plurality of sheets of recording media P, so as to increase the actual circulated sheet number C of the plurality of sheets by a number corresponding to the at least one sheet held at the pair of reversing rollers 41 so that the actual circulated sheet number C is larger than a predetermined circulated sheet number Cs by the number corresponding to the at least one sheet held at the pair of reversing rollers 41, where the predetermined circulated sheet number Cs is determined in accordance with the conveyance direction length L of the recording media P. As opposed to the circulation of the predetermined sheet number Cs of recording media P, the circulation of the increased actual circulated sheet number C of recording media P diminishes the conveyance interval between the last sheet of recording media P and the first sheet of recording media P, resulting in less frequent time lags. This increases the number of printed sheets per unit time, and advantageously inhibits the degradation of the duplex productivity that may otherwise be caused by variations in the conveyance direction length L of the recording media P.

Also in the above-described embodiment, the controller transposes the images to be printed in accordance with the discharge order of the sheets of recording media P, as determined by holding of a sheet of recording media P at the holding reversing unit. This ensures discharge of the sheets of recording media P according to the image order, and eliminates or minimizes a mismatch between the discharge order of the sheets of recording media P and the order of the images printed on the sheets of recording media P. This advantageously maintains user friendliness.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus comprising:

a circulation unit comprising a plurality of reversing units each configured to reverse a sheet of recording media having one surface printed at an image processor, the circulation unit being configured to re-feed the reversed sheet of recording media to the image processor; and a controller configured to, during duplex printing of a plurality of sheets of recording media through circulation in the circulation unit, (i) control one reversing unit among the plurality of reversing units to hold at least one sheet among the plurality of sheets, (ii) while the one reversing unit is holding the at least one sheet, circulate at least one other sheet among the plurality of sheets between the circulation unit and another reversing unit among the plurality of reversing units that is not holding the at least one sheet, and (iii) after the at least one other sheet has passed the another reversing unit, control the one reversing unit holding the at least one sheet to release the at least one sheet, so as to increase an actual circulated sheet number of the circulated plurality of sheets by a number corresponding to the at least one sheet held at the one reversing unit so that the increased actual circulated sheet number is larger than a predetermined circulated sheet number by the number corresponding to the at least one sheet held at the one reversing unit;

wherein the predetermined circulated sheet number is based on a conveyance direction length of the recording media, and wherein the controller is configured to transpose images to be printed in accordance with a discharge order of the plurality of sheets, the discharge order being determined as a result of holding the at least one sheet at the one reversing unit.

2. The image forming apparatus according to claim 1, wherein the plurality of reversing units comprises two reversing units, and at least one of the two reversing units comprises a discharging unit configured to discharge a printed sheet of recording media.

3. The image forming apparatus according to claim 2, wherein when a printing command includes a received sheet number that is smaller than a number obtained by adding one to the predetermined circulated sheet number, the controller is configured not to control the one reversing unit to hold the at least one sheet and to set the actual circulated sheet number at the predetermined circulated sheet number.

4. The image forming apparatus according to claim 2, wherein when (i) the conveyance direction length of the recording media is a predetermined length, and (ii) a scheduled printed sheet number is a multiple of a number obtained by adding one to the predetermined circulated sheet number, the controller is configured to control the one reversing unit to hold the at least one sheet, and to set the actual circulated sheet number at the number obtained by adding one to the predetermined circulated sheet number.

5. The image forming apparatus according to claim 2, wherein the controller is configured to prohibit the one reversing unit from holding the at least one sheet when, during a printing operation, a change is made to a printing condition comprising at least one of the conveyance direction length of the recording media, a paper type, a printing mode, and a process speed.

6. The image forming apparatus according to claim 1, wherein when the at least one sheet held at the one reversing unit is exposed to outside the image forming apparatus, the controller is configured to control a notifier coupled to the controller to make a notification to prohibit removal of the at least one sheet.

7. The image forming apparatus according to claim 1, wherein the at least one other sheet comprises a number of sheets circulable in the circulation unit, and the controller is configured to control the one reversing unit holding the at least one sheet to release the at least one sheet after all the number of sheets have passed the another reversing unit.

8. An image forming apparatus comprising:

a circulation unit comprising a plurality of reversing units each configured to reverse a sheet of recording media having one surface printed at an image processor, the circulation unit being configured to re-feed the reversed sheet of recording media to the image processor; and a controller configured to, during duplex printing of a plurality of sheets of recording media through circulation in the circulation unit, (i) control one reversing unit among the plurality of reversing units to hold at least one sheet among the plurality of sheets, (ii) while the one reversing unit is holding the at least one sheet, circulate at least one other sheet among the plurality of sheets between the circulation unit and another reversing unit among the plurality of reversing units that is not holding the at least one sheet, and (iii) after the at least one other sheet has passed the another reversing unit, control the one reversing unit holding the at least one sheet to release the at least one sheet, so as to increase an actual circulated sheet number of the circulated plurality of sheets by a number corresponding to the at least one sheet held at the one reversing unit so that the increased actual circulated sheet number is larger than a predetermined circulated sheet number by the number corresponding to the at least one sheet held at the one reversing unit;

wherein the predetermined circulated sheet number is based on a conveyance direction length of the recording media, and wherein the at least one other sheet comprises a number of sheets circulable in the circulation unit, and the controller is configured to control the one reversing unit holding the at least one sheet to release the at least one sheet after all the number of sheets have passed the another reversing unit.

9. The image forming apparatus according to claim 8, wherein the plurality of reversing units comprises two reversing units, and at least one of the two reversing units comprises a discharging unit configured to discharge a printed sheet of recording media.

10. The image forming apparatus according to claim 9, wherein when a printing command includes a received sheet number that is smaller than a number obtained by adding one to the predetermined circulated sheet number, the controller is configured not to control the one reversing unit to hold the at least one sheet and to set the actual circulated sheet number at the predetermined circulated sheet number.

11. The image forming apparatus according to claim 9, wherein when (i) the conveyance direction length of the recording media is a predetermined length, and (ii) a scheduled printed sheet number is a multiple of a number obtained by adding one to the predetermined circulated sheet number, the controller is configured to control the one reversing unit to hold the at least one sheet, and to set the actual circulated sheet number at the number obtained by adding one to the predetermined circulated sheet number.

12. The image forming apparatus according to claim 9, wherein the controller is configured to prohibit the one reversing unit from holding the at least one sheet when, during a printing operation, a change is made to a printing condition comprising at least one of the conveyance direction length of the recording media, a paper type, a printing mode, and a process speed.

13. The image forming apparatus according to claim 8, wherein when the at least one sheet held at the one reversing unit is exposed to outside the image forming apparatus, the controller is configured to control a notifier coupled to the controller to make a notification to prohibit removal of the at least one sheet.

14. An image forming apparatus comprising:

a circulation unit comprising a plurality of reversing units each configured to reverse a sheet of recording media having one surface printed at an image processor, the circulation unit being configured to re-feed the reversed sheet of recording media to the image processor; and a controller configured to, during duplex printing of a plurality of sheets of recording media through circulation in the circulation unit, (i) control one reversing unit among the plurality of reversing units to hold at least one sheet among the plurality of sheets, (ii) while the one reversing unit is holding the at least one sheet, circulate at least one other sheet among the plurality of sheets between the circulation unit and another reversing unit among the plurality of reversing units that is not holding the at least one sheet, and (iii) after the at least one other sheet has passed the another reversing unit, control the one reversing unit holding the at least one sheet to release the at least one sheet, so as to increase an actual circulated sheet number of the circulated plurality of sheets by a number corresponding to the at least one sheet held at the one reversing unit so that the increased actual circulated sheet number is larger than a predetermined circulated sheet number by the number corresponding to the at least one sheet held at the one reversing unit;

wherein the predetermined circulated sheet number is based on a conveyance direction length of the recording media, wherein the plurality of reversing units comprises two reversing units, and at least one of the two reversing units comprises a discharging unit configured to discharge a printed sheet of recording media, and wherein the controller is configured to prohibit the one reversing unit from holding the at least one sheet when, during a printing operation, a change is made to a printing condition comprising at least one of the conveyance direction length of the recording media, a paper type, a printing mode, and a process speed.

15. The image forming apparatus according to claim 14, wherein when a printing command includes a received sheet number that is smaller than a number obtained by adding one to the predetermined circulated sheet number, the controller is configured not to control the one reversing unit to hold the at least one sheet and to set the actual circulated sheet number at the predetermined circulated sheet number.

16. The image forming apparatus according to claim 14, wherein when (i) the conveyance direction length of the recording media is a predetermined length, and (ii) a scheduled printed sheet number is a multiple of a number obtained by adding one to the predetermined circulated sheet number, the controller is configured to control the one reversing unit to hold the at least one sheet, and to set the actual circulated sheet number at the number obtained by adding one to the predetermined circulated sheet number.

17. The image forming apparatus according to claim 14, wherein when the at least one sheet held at the one reversing unit is exposed to outside the image forming apparatus, the controller is configured to control a notifier coupled to the controller to make a notification to prohibit removal of the at least one sheet.

18. The image forming apparatus according to claim 14, wherein the at least one other sheet comprises a number of sheets circulable in the circulation unit, and the controller is configured to control the one reversing unit holding the at least one sheet to release the at least one sheet after all the number of sheets have passed the another reversing unit.

* * * * *